United States Patent [19]

Vander Ley et al.

[11] 4,274,689

[45] Jun. 23, 1981

[54] DRAWER GLIDE ASSEMBLY

[75] Inventors: Robert J. Vander Ley, Jenison; Frederick G. Sherman, Grand Rapids, both of Mich.

[73] Assignee: Leslie Metal Arts Company, Grand Rapids, Mich.

[21] Appl. No.: 73,705

[22] Filed: Sep. 10, 1979

[51] Int. Cl.[3] ..... A47B 88/00; F16C 21/00

[52] U.S. Cl. ..... 312/333; 308/3.8; 312/341 R; 312/348

[58] Field of Search ..... 312/319, 333, 341 R, 312/348; 108/87; 308/3.6, 3,8

[56] References Cited

U.S. PATENT DOCUMENTS

| | | | |
|---|---|---|---|
| 3,099,501 | 7/1963 | Hillson et al. | 312/341 R |
| 3,911,835 | 10/1975 | Schill | 308/3.6 |
| 3,954,315 | 5/1976 | Sanden | 312/333 |
| 3,973,814 | 8/1976 | Entriken | 312/333 |
| 3,995,927 | 12/1976 | Stein | 312/333 |
| 4,065,196 | 12/1977 | Stein | 312/333 |
| 4,077,677 | 3/1978 | Sekevich | 308/3.6 |

*Primary Examiner*—Casmir A. Nunberg
*Attorney, Agent, or Firm*—John E. McGarry; Richard A. Gaffin

[57] ABSTRACT

A drawer glide assembly has a positively actuated locking mechanism which prevents accidental disengagement of the drawer (10) from the cabinet rails (12). The locking mechanism includes a lever arm (20) pivotally mounted on a bracket (18) on the drawer rail (11). The lever arm slides along the lower wall (14) of the cabinet rail (12) and is received within a slot (25) in the rail (12). The locking mechanism includes a handle (32) which pivots upwardly to disengage the stop member (30) from the slot (25), allowing easy removal of the drawer (10) from the cabinet (8). Additionally, the rails are provided with an offset guide track in which rollers (21), (22) are guided in order to facilitate movement of the drawer (10). The use of such an offset guide track permits the rails (11), (12) to be mounted to the drawer (10) or cabinet (8) by means of pan-head screws (50). In this way, the screws (50) do not have to be recessed into the cabinet (8) or drawer (10) and do not interfere with the operation of the guide assembly.

11 Claims, 5 Drawing Figures

DRAWER GLIDE ASSEMBLY

BACKGROUND OF THE INVENTION

1. Technical Field

The invention relates to drawer glide assemblies having a locking mechanism which prevents accidental disengagement of the drawer from the cabinet.

2. Background Art

It is well known to mount drawers in a cabinet on cooperating slide-and-roller assemblies. The slides are typically elongate channels having a U-shaped cross-section. The rollers are journaled on mounting brackets which extend from an end of the channel members so that the roller slidably engages the opposite track member when the drawers are inserted within the cabinet. Such drawer glide assemblies provide for easy movement of the drawer within the cabinet and minimize the amount of friction generated when the drawer is opened and closed.

It is also well known in the art to provide a means for limiting the distance by which the drawer may be withdrawn to prevent accidental disengagement of the drawer from the cabinet.

Such a drawer slide including a locking mechanism is disclosed in U.S. Pat. No. 3,995,927, issued Dec. 7, 1976, in which the channel includes a roller bracket carrying a pawl-like latch. The pawl is pivotably mounted on the bracket carried by the drawer channel and rides against the upper surface of the cabinet rail when the drawer is moved. In order for the drawer to be locked in place when it is extended, it is necessary for the pawl to rotate upwardly into a slot disposed on the upper rail of the cabinet channel.

U.S. Pat. No. 4,065,196, issued Dec. 27, 1977, discloses a drawer slide assembly having latching mechanism which is actuated by engagement with the drawer roller.

The locking mechanisms such as those disclosed above possess certain disadvantages. In U.S. Pat. No. 3,995,927, when the drawer is pulled outwardly after the panel engages the slot, a horizontally-directed force acts on the face of the pawl in the slot which tends to cause a counterclockwise pivoting of the latch. Accordingly, the pawl will tend to disengage from the slot. Additionally, a gravitationally actuated locking mechanism which requires the locking portion to be rotated upwardly into a slot may not be actuated due to deformation of the pawl or the accumulation of dirt around the pivot pin. The mechanism disclosed in U.S. Pat. No. 4,065,196 requires a positive force to be applied to the locking mechanism in order to prevent disengagement of the drawer.

SUMMARY OF THE INVENTION

The invention provides an improved drawer glide assembly in which the locking mechanism is gravitationally actuated to pivot a latch downwardly into a slot on a cabinet rail. The drawer glide assembly includes the typical longitudinally extending channels carrying rollers which slidably engage the opposed channels when the drawer is inserted within the cabinet.

The locking mechanism of the invention consists of a plastic stop which is pivoted on a pin fixed on the roller bracket carried by the drawer rail. The plastic stop is pivotably mounted to the bracket so that the stop rides in the cabinet guide track during movement of the drawer. When the drawer is fully extended, the plastic stop drops into a recess provided at the front end of the cabinet guide rail in order to prevent disengagement of the drawer from the cabinet. If it is desired to remove the drawer, lever arms provided on the plastic stop permit the latching mechanism to be lifted from the recess.

The locking mechanism of the present invention provides a gravitationally actuated latch which does not interfere with the operation of the drawer. Thus, the locking mechanism is always subjected to a positive actuating force and the possibility that the mechanism will not operate is reduced.

The present invention also provides a drawer glide assembly which is more easily secured to the cabinet structure. The channel members have guide tracks which are slightly offset from the side of the rails to permit the attachment of the rail to the cabinet through the use of pan head screws and the like. In this way, the need for recessing the screws within the channel or the cabinet is eliminated.

BRIEF DESCRIPTION OF THE DRAWINGS

The present invention will be described with reference to the accompanying drawings wherein like members bear like reference numerals, in which.

DETAILED DESCRIPTION OF THE PREFERRED EMBODIMENT

Figure 5:
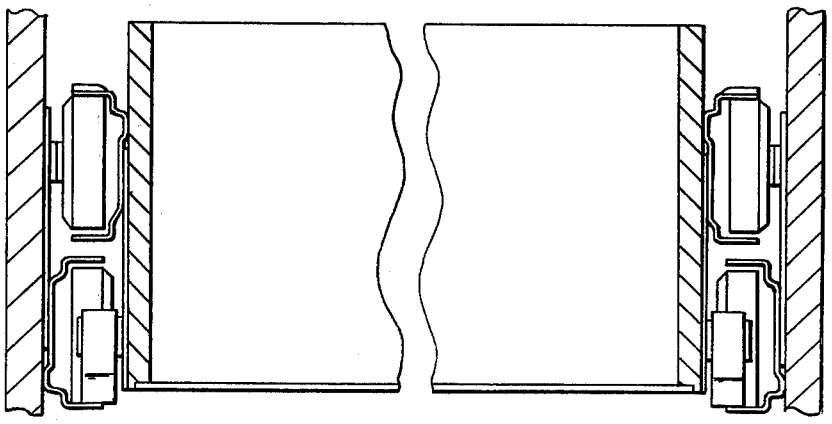
FIG. 5 is a front view of the drawer glide assembly with the front panel of the drawer removed.

With reference to the accompanying drawings, a drawer 10 is mounted to a cabinet 8 by means of a drawer glide assembly according to the invention. The drawer glide assembly includes drawer rails 11 secured to the side panels of the drawer and cabinet rails 12 secured to the inner surfaces of the cabinet 8. The rails are typically elongate channel members having a generally U-shaped cross-section. Each rail has a longitudinally-extending flat center portion 15 and a pair of parallel spaced side walls 13 and 14. The side walls 13 and 14 define a guide track in which rollers are disposed to facilitate opening and closing of the drawer. The channels are formed in a known manner which may include stamping from sheet metal or the like. As shown in FIG. 5, the side walls of the channel may be slightly spaced from the base in order to offset the guide track. In such an embodiment, elongate web portions 16 extend laterally from the longitudinal edges of the center portion 15 and a pair of upstanding flanges 17 integrally formed with the channel extend from the web portions 16. The side walls 13 and 14 accordingly extend from the distal portions of the flanges 17. By slightly displacing the side walls from the plane of the base, it is possible to mount the channels with ordinary pan-head screws 50 and eliminate the need for recessing the screws into the rails or the cabinet structure. This offset permits rollers disposed within the channel to slide freely in the rail without interference.

Figure 1:
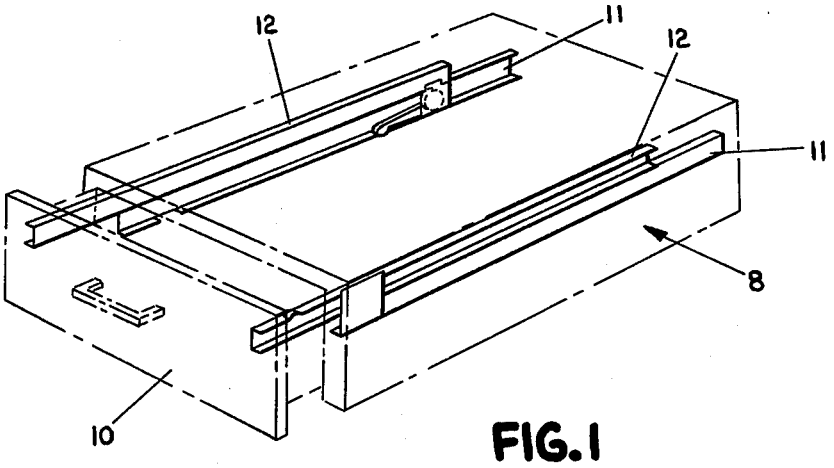
FIG. 1 is a perspective view of a drawer showing the drawer glide assembly of the present invention.
Figure 2:
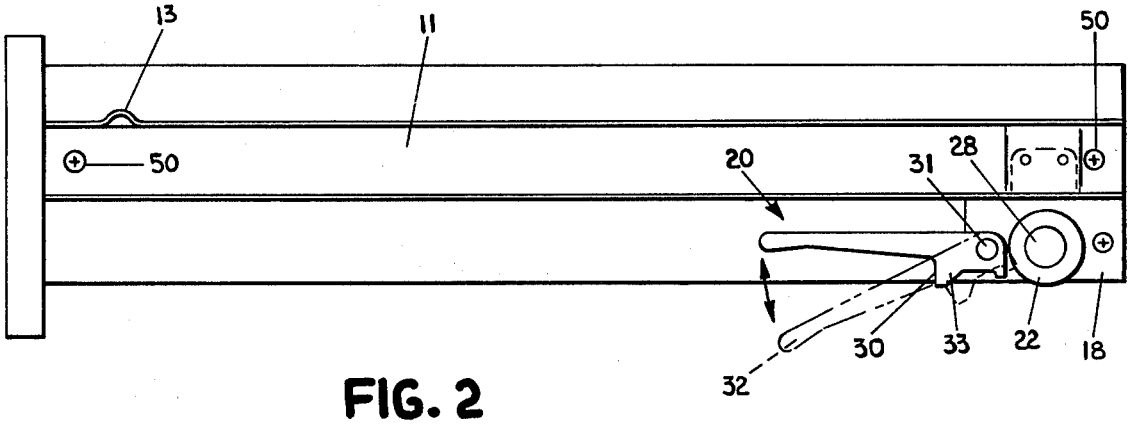
FIG. 2 is a side view of a rail mounted on a drawer which carries the locking arm of the present invention.

As shown in FIG. 2, a mounting bracket 18 is secured to the rear portion of the rail 11. The mounting bracket 18 includes having a flange 24 which is received in a depression 26 formed in the back surface of the rail 11. The flange 24 seats against the back surface of the rail 25 to provide a smooth surface for mounting on the drawer 10.

A roller 22 is pivotably secured on the mounting bracket 18 by a pin 28. Ball bearings are typically seated within a race defined by the outer surface of the pin 20 and the inner annular surface of the roller 22.

The mounting bracket 18 carries a pivotably mounted lever arm 20 which is part of the locking mechanism of the present invention.

Figure 3:
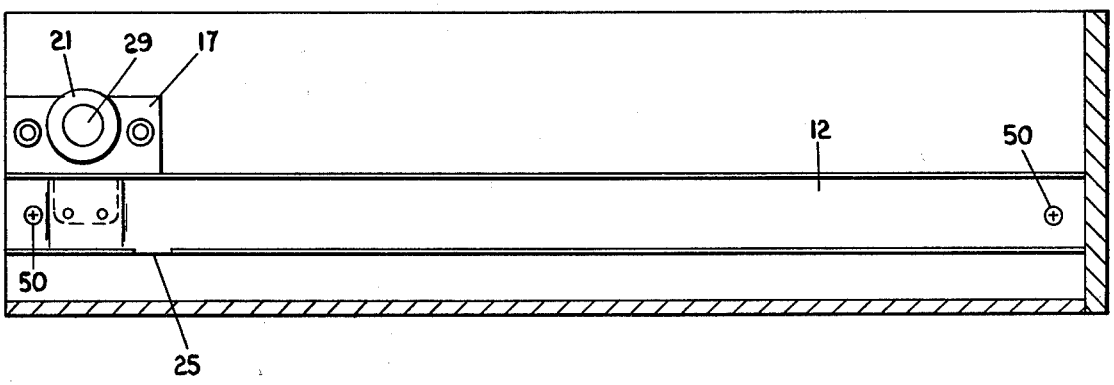
FIG. 3 is a side view of a cabinet having a guide rail mounted thereon.

The cabinet rail 12 is shown in FIG. 3 and is similar to the above-described drawer rail 11. A mounting bracket 17 secured to the front portion of the rail 12 is seated in a depression 27 in the back surface of the rail. A roller 21 is pivotably mounted on the bracket 17 by a pin 27 and includes the above described bearing structure.

The locking mechanism of the invention includes a lever arm 20 which is pivotably mounted on the mounting plate 18 by a pin 31. The lever arm 20 is typically formed of a hard plastic material which allows for smooth sliding of the arm over the cabinet rail when the drawer is opened and closed. The lever arm 20 extends forwardly from the pin 31 to define a handle portion 32. A stop member 30 extends from the lower surface of the arm 20 and rides on the lower side web of the cabinet rail 12 when the drawer 10 is opened. The rear surface of the stop member 30 defines a cam surface 33 for preventing engagement of the stop member 30 when the drawer 10 is inserted into the cabinet 8.

A slot 25 in the lower side web of the cabinet rail 12 receives the stop member 30 when the drawer is pulled out. Accordingly, the lever arm 20 is gravitationally actuated when the stop member 30 is aligned with the slot 25.

The relative positions of the stop member 30 and the pivot pin 31 tend to retain the stop member 30 within the slot 25 when the drawer is pulled outwardly. As the drawer is pulled out, the stop member 30 engages the forward edge of the slot 25, exerting a horizontal force on the pin 31. This force causes a counterclockwise pivoting of the lever arm 20 which forces the stop member 30 into the slot 25. In this way, the locking action of the stop member is enhanced.

Figure 4:
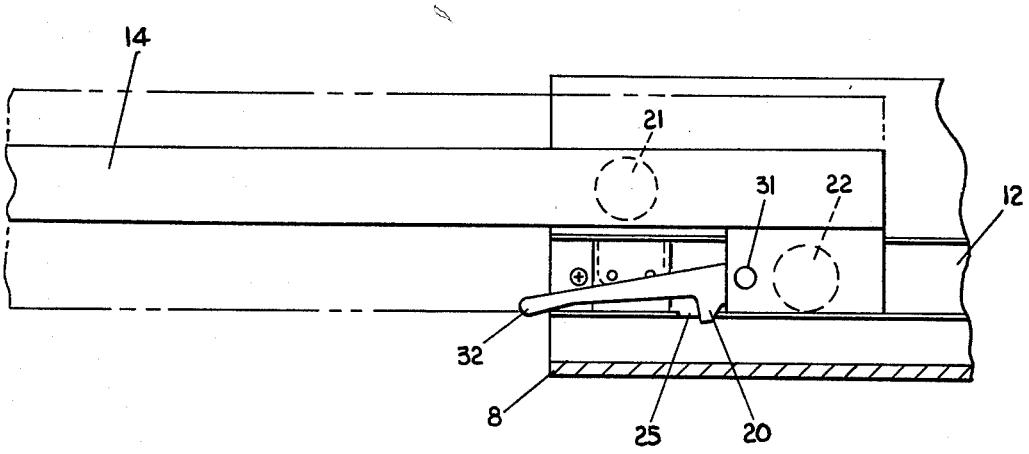
FIG. 4 is a side view of the locking mechanism of the present invention in the locked position.

When the drawer is fully extended, the handle portion 32 of the lever arm 20 projects beyond the edge of the cabinet 8, as shown in FIG. 4.

With reference to FIG. 5, the positions of the rails 11 and 12 and the respective rollers 21 and 22 are shown. When the drawer glide is assembled, the roller 22 is slidably engaged within the cabinet rail 12 and the roller 21 is likewise engaged within the guide track on the drawer rail 11. As can be seen from FIG. 5, the lever arm 20 rides forwardly of the roller 22. If it is necessary to remove the drawer 10 from the cabinet 8, the stop member 30 may be easily disengaged from the slot 25 by pivoting the handle 32 upwardly. In order to reinsert the drawer, it is only necessary to align the drawer and channel rails properly since the cam surface 33 on the stop member 30 rides over the slot 25 when the rollers 22 are slid into the cabinet rail 12.

The above-described invention provides a relatively simple locking mechanism which prevents disengagement of the drawer from the cabinet rails. The locking mechanism is subjected to a constantly acting positive actuating force which minimizes the chance of disengagement of the drawer from the cabinet rail. Additionally, the arrangement of the stop member relative to the pivot also tends to increase the actuating force when the drawer is extended. Since the locking mechanism pivots downwardly into the stop member, the possibility of the locking mechanism failing to engage the recess is reduced, when compared to those locking mechanisms in which the latch must swing upwardly into a recess. Additionally, a gravitationally actuated locking mechanism allows the use of a device having relatively few moving parts which reduces the wear and tear on the glide assembly. Those locking mechanisms which are actuated by engagement with a component of the glide assembly are subjected to increased wear due to the frequent contacting of the components of the locking mechanism. By providing extending arms on the locking mechanism, removal of the drawer from the cabinet is made simple.

The above-described glide assembly also facilitates mounting of the rails on the cabinet and drawers by providing offset glide tracks. In this way, pan head screws can be used to attach the tracks to the drawers or cabinets without interfering with the operation of the rollers.

The use of plastic arms for the locking mechanism also eliminates much of the noise generated when the drawer is opened or closed. In the past, metal arms which rode over adjacent rail surfaces were used and such arms generated annoying scraping sounds.

Additionally, the cabinet and drawer rails are identical without the locking device. Accordingly, positions of the rails may be interchanged.

The foregoing specification and drawings are merely illustrative of the present invention and are not intended to limit the invention to the disclosed embodiment. Variations and changes which are obvious to one skilled in the art are intended to be within the scope and nature of the present invention.

The embodiments of the invention in which an exclusive property or privilege is claimed are defined as follows:

1. A drawer glide assembly comprising:

first and second longitudinally extending channel members, each of said channel members including a central web and a pair of spaced parallel side webs perpendicular to the plane of said central web, said channel members being disposed in a vertical arrangement with the lower side web of said first channel member adjacent the upper side web of said second channel member and the central webs in a laterally spaced parallel relationship;

a mounting bracket secured to and extending from each of said channel members at an end thereof;

a roller rotatably mounted on each mounting bracket and extending into the guide channel defined by said side webs of an opposing track member;

a lever arm pivotably mounted on said mounting bracket secured to said first channel member;

a stop member disposed on the lever arm and in sliding engagement with the lower side web of said second channel member; and stop means on the lower side web of said second channel member for engaging said stop member so as to limit relative longitudinal displacement of said channel members;

wherein said stop member pivots downwardly with respect to said lower side web of said second channel member upon alignment of the stop member and said stop means.

2. The drawer glide assembly of claim 1 wherein said stop member includes a cam on a lower surface thereof and said stop means is an opening for receiving said cam.

3. The drawer glide assembly of claim 2 wherein said lever arm is pivotally mounted forward of said roller secured to the bracket.

4. The drawer glide assembly of claim 3 wherein the lever arm extends forwardly from the mounting bracket to project past the front edge of the second channel member when said stop member is in engagement with said stop means.

5. The drawer glide assembly of claim 1 wherein said mounting bracket includes a flange which is received in a depression formed in the back surface of said central web in a generally overlapping relationship therewith.

6. The drawer glide assembly of claim 1 wherein said side webs are transversely spaced from the elongate edges of said central web to define a guide channel which is spaced from the plane of said central web.

7. The drawer glide assembly of claim 5 wherein said flange is secured to said channel member by at least one rivet.

8. The drawer glide assembly of claim 6 wherein said cabinet and drawer channels are secured to a respective cabinet and drawer by screws, said screws including a head portion having a thickness which is less than the spacing of the side webs from the plane of said central web.

9. The drawer glide assembly of claim 1 wherein said lever arm is plastic.

10. The drawer glide assembly of claim 1 wherein said lever arm is pivotably mounted on a pin carried on said bracket.

11. The drawer glide assembly of claim 1 wherein the relative positions of said cam and said pin tend to cause a downwards pivoting of said lever arm with respect to said lower side web of said second channel member.

* * * * *